United States Patent [19]

Berchem

[11] Patent Number: 4,561,908

[45] Date of Patent: Dec. 31, 1985

[54] METHOD OF MAKING FORGED STEEL ARTICLES, ESPECIALLY FOR VEHICLE PARTS

[75] Inventor: Rütger Berchem, Gelsenkirchen, Fed. Rep. of Germany

[73] Assignee: Berchem & Schaberg GmbH, Gelsenkirchen, Fed. Rep. of Germany

[21] Appl. No.: 471,515

[22] Filed: Mar. 2, 1983

[30] Foreign Application Priority Data

Mar. 2, 1982 [DE] Fed. Rep. of Germany ..... 3207358

[51] Int. Cl.[4] ..... C21D 1/02; C21D 1/06

[52] U.S. Cl. ..... 148/12 F; 148/39

[58] Field of Search ..... 75/128 W; 148/36, 12 F, 148/150, 146, 39, 16.5; 72/377

[56] References Cited

U.S. PATENT DOCUMENTS

| | | | |
|---|---|---|---|
| 3,027,253 | 3/1962 | Yeo | 75/128 W |
| 3,352,724 | 11/1967 | McNitt et al. | 148/39 |
| 4,173,501 | 11/1976 | Hildebrandt et al. | 148/16.5 |
| 4,392,623 | 7/1983 | Munsen et al. | 244/102 R |
| 4,409,841 | 10/1983 | Archer | 73/762 |

FOREIGN PATENT DOCUMENTS

| | | | |
|---|---|---|---|
| 44756 | 4/1981 | Japan | 75/128 W |
| 832403 | 4/1960 | United Kingdom | 148/16.6 |

OTHER PUBLICATIONS

Molybdenum in Steel, Climax Molybdenum Company, New York, New York, 1938, Section 3, pp. 2, 4, 5, 7, 8 and 9.

*Forging Design Handbook*, American Society for Metals, Metals Park, Ohio, 1972, pp. 43–44.

Metals Handbook, Heat Treating, vol. 4, 1981, American Society for Metals, pp. 120, 121 and 122.

*Primary Examiner*—Peter K. Skiff

*Attorney, Agent, or Firm*—Karl F. Ross; Herbert Dubno

[57] ABSTRACT

Vehicle suspension parts especially parts which may be subjected to temperatures as low as −50° C. are made by forging them from a steel of the following composition: 0.35 to 0.45% by weight carbon, less than 0.5% by weight silicon, 0.6 to 0.9% by weight manganese, 0.7 to 1.1% by weight chromium, 0.25 to 0.45% by weight molybdenum, 1.6 to 2.1% by weight nickel, the balance being substantially iron and the usual impurities.

3 Claims, 2 Drawing Figures

METHOD OF MAKING FORGED STEEL ARTICLES, ESPECIALLY FOR VEHICLE PARTS

FIELD OF THE INVENTION

My present invention relates to a method of making forged steel members, especially forged steel members which can form parts for a vehicle body, chassis or suspension system, to a steel composition for use in this method and in the production of such articles, and, more generally, to the production of vibration-absorbing steel members for vehicular body applications which have a high resistance to fatigue failure, i.e. an anti-fatigue strength as measured by direct flexure or repeated bending test methods.

BACKGROUND OF THE INVENTION

In many vehicle body applications it is necessary to provide parts having a high endurance, i.e. resistance to fatigue, as measured by the direct flexure or repeated bending tests.

Good results under these tests are indicative of the ability of the part to withstand variations in loading, frequency and amplitude of stresses, and, more generally, a resistance to fluctuations in the location, magnitude and timing of stress applications. Direct flexure or repeated bending tests are generally tests in which the article is subjected to bending from one side to another repeatedly. Such tests thus measure a certain kind of fatigue resistance which is particularly desirable in vehicle body applications and, especially, in applications for vehicular suspensions, e.g. road vehicle suspensions and aircraft landing gear, where the parts are subjected to vibration and load-directional change stresses to an inordinate degree.

It has been known to fabricate parts which may be subjected to such loading from steels having a carbon content of 0.2 to 0.45% by weight, and containing small quantities of alloying components, such as chromium and manganese individually or in combination or in binary combination with other alloying ingredients.

Typical steels, which have been used for this purpose, are CK 45, CK 35, 16 MnCr 5, and 41 Cr 4. Larger parts can be fabricated, for example, from 42 Cr Mo 4.

In general, utilizing the known characteristics of such steel, the design engineer must dimension the part which is to be fabricated to be capable of withstanding the stresses to be taken up by the part. Naturally, where the materials are less than satisfactory, as is the case with the steels mentioned, in resisting fatigue or the type represented by the direct flexure testing, the parts must be made somewhat larger and heavier than might otherwise be desirable.

When the parts are fabricated in a sheet metal construction, i.e. consist of profiled sheet materials, they must be dimensioned to be comparatively large to be able to withstand the applied stresses and take up considerable space. When sheet metal construction is not contemplated and the parts are fabricated by casting, for example, they are comparatively massive.

For optimum vehicle design, the suspended mass must be minimized. Since elements of the type described above are frequently used in the suspension itself, this means that the weight of these elements can be critical.

Thus there is a need to minimize the weight of such elements. However, since the structural integrity of the vehicle depends upon the ability of such elements to withstand said changes in applied stress, overloading and the like, it is imperative that the elements not only be designed to withstand the applied stress or for a considerable margin of safety therewith, but also be subjected to destructive testing of production samples as well as to nondestructive testing of the parts used, to ensure the ability of the parts to withstand overloads. These testing techniques may contribute up to 5% of the cost of these parts and may thus make a significant contribution to the overall cost of the vehicle. In certain cases, these costs can be prohibitive.

Indeed, certainty as to performance of the parts hitherto fabricated from the aforementioned steels can only be obtained by testing each individual part at considerable cost and even then total reliability could not be assured under all circumstances. Since complete testing was not always practical from an economical point of view, the use of such parts was always a compromise between the various conditions set forth above.

The problem was complicated even further by the fact that parts made by conventional techniques from the aforementioned steels, when subjected to surface treatments, e.g. hardening, hard facing and the like, or when subjected to machining, were found to be subject to additional stresses whose effects on the fatigue resistance of the product was not always predictable or satisfactory.

OBJECTS OF THE INVENTION

It is the principal object of the present invention to improve upon the art of fabricating high endurance fatigue resistant parts, especially suspension parts and body parts or vehicles, whereby the aforementioned disadvantages are obviated and, especially, greater security can be provided against certain overloads.

Another object of the invention is to provide parts for the aforementioned purposes which have greater fatigue resistance as measured by the repeated bending tests described, greater resistance to rupture with sudden overloads and, more specifically, greater resistance to failure when subjected to repeated bending fatigue stresses.

Another object of the invention is to provide an improved method of making such articles.

Still another object of the invention is to provide a new use for a steel composition whereby the aforementioned results can be attained.

SUMMARY OF THE INVENTION

These objects and others which will become apparent hereinafter are attained, in accordance with the present invention, which is based upon our discovery that a certain steel, when fabricated into the parts by forging and subjected to machining and surface treatment as will be described below, is surprisingly able to overcome the disadvantages previously described, this steel consisting essentially of 0.35 to 0.45% by weight carbon, (preferably 0.37 to 0.42% carbon and most advantageously 0.39 to 0.41% carbon), less than 0.5% by weight silicon, (preferably between 0.001% silicon and 0.45% silicon and still more advantageously between 0.005% silicon and 0.25% silicon), 0.6 to 0.9% manganese (preferably 0.7 to 0.8% manganese, with best results at about 0.75% manganese), 0.7 to 1.1% by weight chromium, (preferably 0.8 to 1.0% chromium and most advantageously about 0.9% chromium), 0.25 to 0.45% by weight molybdenum, (preferably 0.30 to 0.40% by weight molybdenum and most preferably 0.35% by weight molybdenum), and 1.6 to 2.1% nickel (preferably 1.7 to 2.0% nickel and most preferably 1.8 to 1.9% nickel), the balance being iron and the usual impurities, i.e. impurties unavoidably present in the steel.

For reasons which are not quite clear, this steel is quite distinct from the chromium-molybdenum and chromium-manganese containing steels previously mentioned and shows little stress retention prior to deformation, little development of cold hardening during deformation and a markedly reduced tendency toward fatigue even for multiaxial stresses as measured by direct flexure or repeated bending tests.

Perhaps the most surprising result is the low temperature fatigue resistance of the article forged from this steel. Indeed, I have found, most surprisingly, that the fatigue resistance described above is not only highly pronounced at normal temperatures, but that at temperatures as low as −50° C., the fatigue resistance is marked and thus the parts fabricated by forging from this steel can be utilized highly effectively in vehicle body applications which may subject the parts to temperatures in this low temperature range.

The elements, therefore, are most suitable for vehicular undercarriages and especially aircraft undercarriages which are subjected to high stresses and must in part be able to damp vibrations, oscillations and impacts. I have found that for a given shape and dimensions of a part, designed for the prior materials, the parts of the invention are far better able to withstand sudden stresses and have significantly reduced fatigue. The parts can be made somewhat smaller to comply with the existing stress and fatigue specifications, thereby reducing the suspended weights and loading on the parts themselves and on other parts.

Thus, apart from the fact that the parts of the present invention have high fatigue strength when subjected to repeat bending tests and excellent ability to withstand failure with sudden overloads, especially under direct flexure stress articles, the parts show greater toughness and reduced tendency toward brittleness, stress cracking and the like.

Surprisingly, the material is superficially hardenable without reducing the toughness or tenacity or ductility of its underlying structure. The surface hardening can be effected inductively with a minimum thickness of penetration upon machining, i.e. the removal of material, the body is found to retain its high strength and elongation to break which exceed those of other similar parts.

As noted previously, all of these characteristics are attained at especially low temperatures and hence the parts are especially valuable when used in an aircraft or the like in which the parts may be repeatedly subjected to extremely low temperatures.

Finally, mention may be made of the fact that the parts can easily be surface treated, e.g. coated or subjected to hard facing with tungsten carbide, titanium carbide or like material to enable portions thereof to stiffen to optimize elasticity in certains regions to enable the parts to take up load peaks as may be necessary. Various regions may be case hardened or hardened by heating and quenching as required.

BRIEF DESCRIPTION OF THE DRAWINGS

The above and other objects, features and advantages of the present invention will become more readily apparent from the following description, reference being made to the accompanying drawing in which.

SPECIFIC DESCRIPTION

Figure 1:
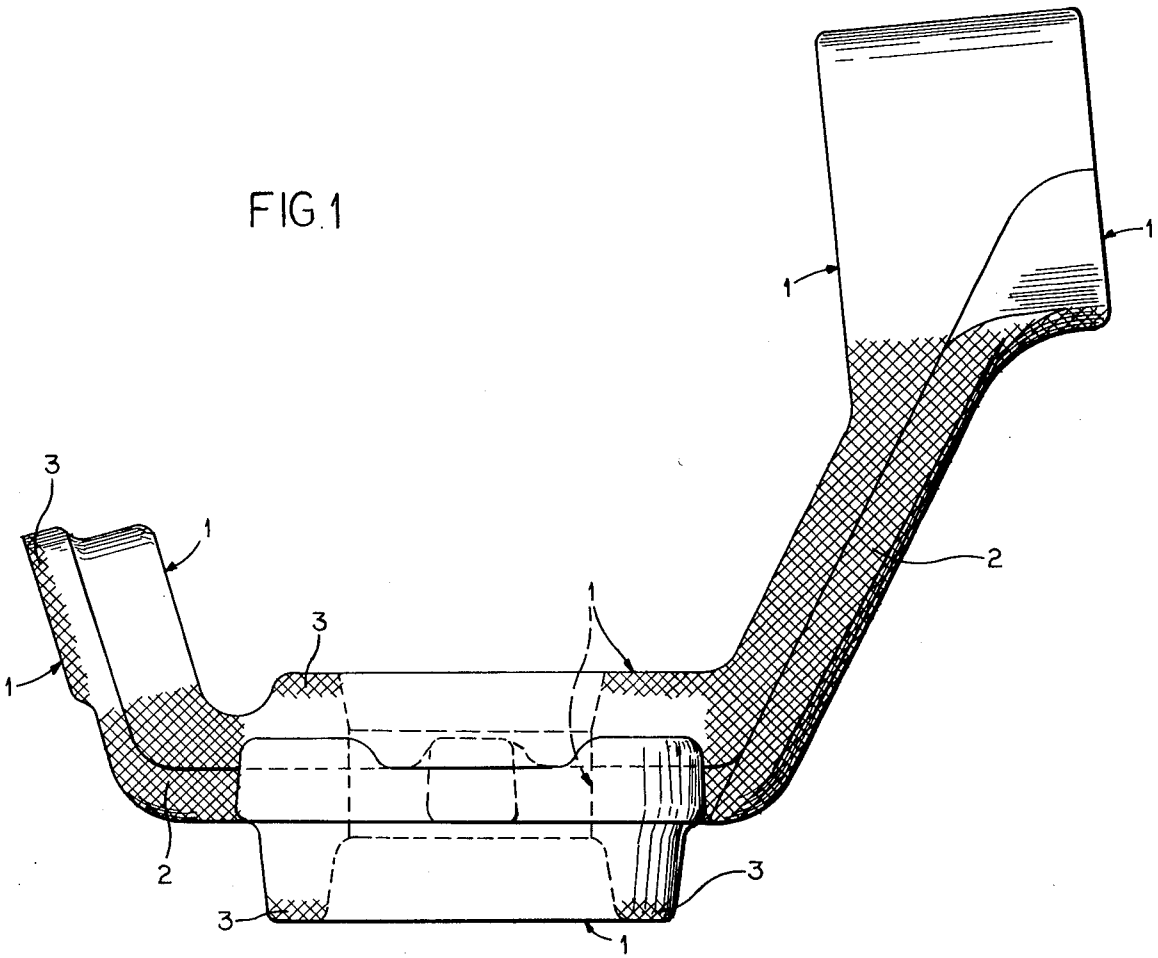
FIG. 1 is a side-elevational view of a steering linkage pivot from a front wheel drive vehicle.

The bearing support for an automotive vehicle shown in FIG. 1 is forged in a female die to the shape shown from a steel consisting of 0.40% by weight carbon, 0.20% by weight silicon, 0.75% by weight manganese, 0.90% by weight chromium, 0.35% by weight molybdenum and 1.85% by weight nickel, the balance being iron and unavoidable impurities.

After forging, the regions represented at 1 were subjected to machining by turning. The regions cross-hatched at 2 were strengthened by localized hardening, i.e. heating to a temperature of about 900° C. and quenching, while the regions 3 were subjected to superficial hardening by inductive heating in a high carbon atmosphere.

Figure 2:
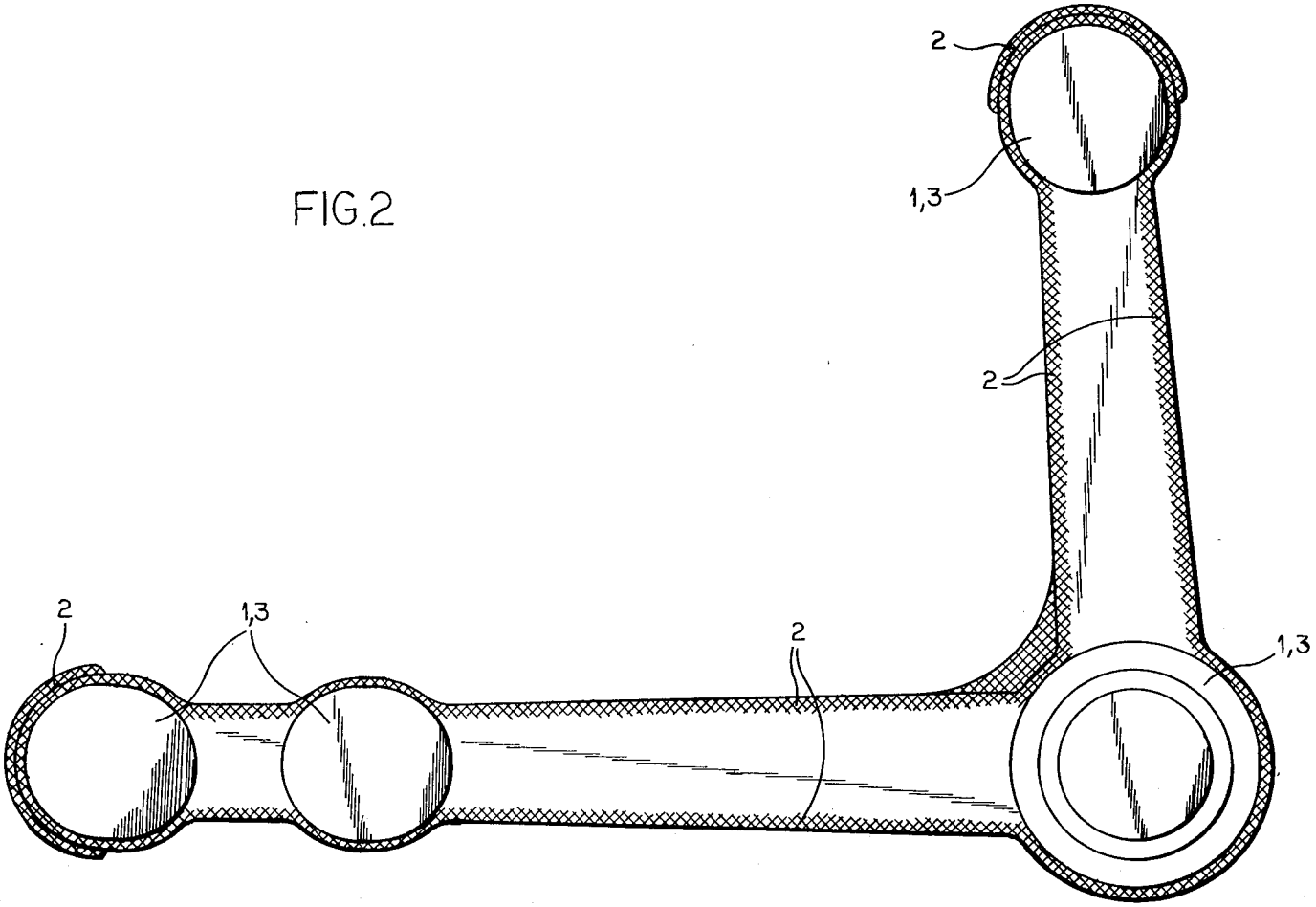
FIG. 2 is an elevational view of a steering linkage lever of the bell-crank type for use in a bus-type vehicle.

In the case of the embodiment of FIG. 2, the various regions 1, 2 and 3 were similarly treated with ribs being formed along the longitudinal edges during the forging process as represented at 2. These ribs, while increasing the strength also constitute preferential rupture zones at which incipient failure could be noted by visual inspection so that a tendency of the part to fail in use is readily ascertained by viewing the cracks developing in the ribs denoted by the hardened zones 2 in FIG. 2.

I claim:

1. A method of making a vehicle body undercarriage part with high resistance to alternating-stress fatigue which comprises the steps of:

(a) forging a vehicle body undercarriage part subject to temperatures as low as −50° C. from a steel consisting essentially of 0.35 to 0.45% by weight carbon, less than 0.5% by weight silicon, 0.6 to 0.9% by weight manganese, 0.7 to 1.1% by weight chromium, 0.25 to 0.45% by weight molybdenum, 1.6 to 2.1% by weight nickel, the balance being substantially iron and the usual impurities, said part being forged with an all-around rib increasing the strength of the part and providing visible evidence of fatigue failure of the part;

(b) selectively machining portions of the forged part made in step (a); and (c) selectively hardening those portions of the machined and forged part subject to inordinate vibration and load-directional change stresses.

2. The method defined in claim 1 wherein said steel has substantially the following composition: about 0.4% by weight carbon, less than 0.25% by weight silicon, about 0.75% by weight manganese, about 0.9% by weight chromium, about 0.35% by weight molybdenum, about 1.9% by weight nickel, the balance being iron and unavoidable impurities.

3. A forged and machined vehicle suspension part adapted to be subjected to temperatures as low as −50° C., forged with an all around rib increasing the strength of the part and providing visible evidence of fatigue failure of the part, having the following composition: 0.35 to 0.45% by weight carbon, less than 0.5% by weight silicon, 0.6 to 0.9% by weight manganese, 0.7 to 1.1% by weight chromium, 0.25 to 0.45% by weight molybdenum, 1.6 to 2.1% by weight nickel, the balance being substantially iron and the usual impurities in a forged part having high reverse-bending fatigue strength, with different portions of said part, which are subjected to inordinate vibration and load-directional change stresses, being selectively hardened.

* * * * *